US009721487B1

(12) United States Patent
Jeansonne et al.

(10) Patent No.: US 9,721,487 B1
(45) Date of Patent: Aug. 1, 2017

(54) VEHICLE EMERGENCY DISTRESS INDICATOR

(71) Applicants: Joey Jeansonne, Las Vegas, NV (US); Sheryl Jeansonne, Las Vegas, NV (US)

(72) Inventors: Joey Jeansonne, Las Vegas, NV (US); Sheryl Jeansonne, Las Vegas, NV (US)

( * ) Notice: Subject to any disclaimer, the term of this patent is extended or adjusted under 35 U.S.C. 154(b) by 13 days.

(21) Appl. No.: 14/581,189

(22) Filed: Dec. 23, 2014

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC B60Q 7/00; B60Q 7/005; G09F 17/00; G09F 17/0091; G09F 2017/0075
USPC ..... 116/28 R, 173, 174; 40/591, 592, 40/607.05, 607.06; 446/217, 219, 228
See application file for complete search history.

(56) References Cited

U.S. PATENT DOCUMENTS 1,976,264 A * 10/1934 Miner et al. ..... G01C 15/06 116/173
3,938,465 A * 2/1976 Lyons ..... B60Q 7/005 116/206
4,108,311 A * 8/1978 McClendon ..... B60Q 7/005 116/173
4,471,873 A * 9/1984 Thomas ..... B60Q 7/005 116/173
4,590,883 A * 5/1986 Steed et al. ..... B60R 13/005 116/173
4,667,829 A * 5/1987 Edmund-White ..... G09F 7/00 206/216
5,014,641 A * 5/1991 Johnson ..... B62J 6/20 116/28 R
5,048,451 A * 9/1991 Reimers et al. ..... B60Q 1/52 116/35 A
5,495,821 A * 3/1996 Brewer ..... G09F 17/00 116/173
5,568,784 A * 10/1996 Willis et al. ..... G09F 17/00 116/173
5,613,799 A * 3/1997 Guide ..... G09F 13/16 40/412
5,687,946 A * 11/1997 Cho ..... A45B 11/00 248/156
5,899,167 A * 5/1999 Furman ..... F16C 11/0619 116/173
5,924,669 A * 7/1999 Richins ..... G09F 17/00 116/174

(Continued)

FOREIGN PATENT DOCUMENTS

DE 102004008462 A1 * 9/2005 ..... B60Q 7/00
JP 2003345276 A * 12/2003 ..... G09F 17/00

*Primary Examiner* — R. A. Smith
(74) *Attorney, Agent, or Firm* — John D. Gugliotta

(57) ABSTRACT

A distress indicia marker is provided for signaling a vehicle emergency situation. The marker includes an indicia flag, at least one vertical post element, and a securing device. The vertical post element provided to support the indicia flag at an upper end, and a number of vertical post may be interconnected. Each post element is formed as a linearly elongated member in which a receiving coupling is formed at an upper end and an attachment nipple is formed at the lower end. The securing device accepts an attachment nipple of a vertical post element.

19 Claims, 13 Drawing Sheets

(56) References Cited

U.S. PATENT DOCUMENTS

| | | | | |
|---|---|---|---|---|
| 6,349,667 | B1 * | 2/2002 | Rogers et al. | A63C 9/06 116/173 |
| 6,637,718 | B2 * | 10/2003 | Wilson | G09F 17/00 248/157 |
| 6,908,206 | B1 * | 6/2005 | Pinciaro | A41D 27/085 362/34 |
| 7,635,202 | B2 * | 12/2009 | Awabayashi | G09F 13/22 362/249.08 |
| 7,797,869 | B2 * | 9/2010 | Tollis et al. | G09F 7/00 248/156 |
| 8,616,145 | B1 * | 12/2013 | Ferran | G09F 17/00 116/173 |
| 2007/0035956 | A1 * | 2/2007 | Topps | B60Q 7/00 362/473 |
| 2010/0233934 | A1 * | 9/2010 | Tonary et al. | G09F 21/04 446/217 |
| 2014/0104057 | A1 * | 4/2014 | Futrell | B60Q 7/00 340/473 |

* cited by examiner

EMERGENCY DISTRESS INDICATOR

RECEIVING COUPLING
POST ELEMENT
CLAMP

ATTACHMENT NIPPLE
FIRST SECURING DEVICE
55
55

SECOND SECURING DEVICE

THIRD SECURING DEVICE

FIRST SECURING DEVICE

SECOND SECURING DEVICE

70

74

FOURTH SECURING DEVICE

EXPLODED VIEW

VEHICLE EMERGENCY DISTRESS INDICATOR

RELATED APPLICATIONS

There are no previously filed, nor currently any co-pending applications, anywhere in the world.

BACKGROUND OF THE INVENTION

1. Field of the Invention

The present invention relates generally to flags and markers and, more particularly, to a distress indicia marker for signaling emergency situations.

2. Description of the Related Art

Motor vehicles are equipped with numerous safety and indicator devices, such as lights, turn signals and horns. However, the only 'emergency' type of signaling device is a vehicle's "hazard lights". Hazard lights are merely the front and rear signal lights of a vehicle that are activated in a distinctive blinking pattern. While intended to be used to alert other drivers of a problem, this signaling mechanism is merely a one-size-fits-all, generic signaling device that have no single intended meaning or use. Further, as shown in Table 1 below, according to the American Automobile Associations many jurisdictions do not allow the use of "hazard lights" on moving vehicles.

TABLE 1

| Permitted in all or most cases | Not permitted | Permitted only in emergency or hazard situations |
|---|---|---|
| Alabama | Alaska | Arizona |
| Connecticut | Colorado (unless under 25 mph) | Arkansas |
| Washington, DC | Florida | California |
| Georgia | Hawaii | Delaware |
| Kentucky | Illinois | Idaho |
| Michigan | Kansas | Indiana |
| Mississippi | Louisiana | Iowa |
| Missouri | Massachusetts | Maine |
| Nebraska | Nevada | Maryland |
| New Hampshire | New Jersey | Minnesota |
| New York | New Mexico | Montana |
| North Carolina | Rhode Island | Ohio |
| North Dakota | | Oklahoma |
| Oregon | | South Carolina |
| Pennsylvania | | Tennessee |
| South Dakota | | Virginia |
| Texas | | Washington |
| Utah | | West Virginia |
| Vermont | | Wisconsin |
| Wyoming | | |

There are many situations in which a driver of a vehicle may wish to signal an urgent or emergency situation. By way of example, and not as a limitation, expectant parents on the way to a hospital, or private parties transporting people in life threatening situations to a medical facility, may wish to provide a warning indicator to other drivers or the police. Currently, the use of hazard lights in these situations is illegal in 12 states and ambiguous in all 50 states.

Also, in situations where a vehicle is stopped or stranded and the driver or passenger requires assistance, the use of hazard lights does not necessarily communication such a situation. Further, in extreme weather situations such as dangerous snowfall or flooding, a vehicle's hazard lights are usually no more than half way up the vertical height of the vehicle and would be covered and non-visible far sooner than desired or necessary.

Other emergency signaling devices that exist include a bright orange cone, or a chemical flair, or an orange and reflective triangular traffic warning sign, all of which are intended to be placed between approaching traffic and a stopped vehicle.

All such devices, however, merely provide visibility to oncoming traffic, and do nothing to alert first responders or other to the presence of an exigent circumstance. Further, such devices are not attachable to the vehicle itself and therefor can be subject to being lost, moved or confused relevant to a target vehicle.

Consequently, a need exists for a distress indicator for attachment to vehicles that provides the signaling of an emergency or the need for assistance.

SUMMARY OF THE INVENTION

It is thus an object of the present invention to provide a method and apparatus for allowing a driver to signal others concerning an emergency situation.

It is a further object of the present invention to provide such an emergency indicator marker that is removably attachable to any type of vehicle.

Briefly described according to the preferred embodiment of the present invention, an emergency distress indicator is provided as a modular kit including: an indicia flag; at least one vertical post element; and a securing device. The indicia flag may be a rotating/spinning indicator that provides equal visibility about 360° around the emergency distress indicator. Alternately, a pendant type indicia flag may be provided supported cantilevered, unidirectional manner. Various styles of securing device may be included in a kit to allow selection of one best adapted for attachment to whatever surface is available. Such securing devices may include a ground stake or a window bracket that may be impinged in a vehicle window and provide a receiving hole for the vertical post.

An advantage of the present invention is that it allows for greater visibility of a distress indicator for motorists in emergency situations.

An advantage of one aspect of the present invention is that it will allow for secure placement into the ground.

An advantage of another aspect of the present invention is that it will allow for attachment to a railing or similar horizontal surface.

An advantage of yet another aspect of the present invention is that it will allow for attachment to wall or similar vertical surface.

An advantage of still yet another aspect of the present invention is that it will allow for attachment to a vehicle window. Still further such an aspect can allow for attachment of the distress indicator while the vehicle is in motion.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
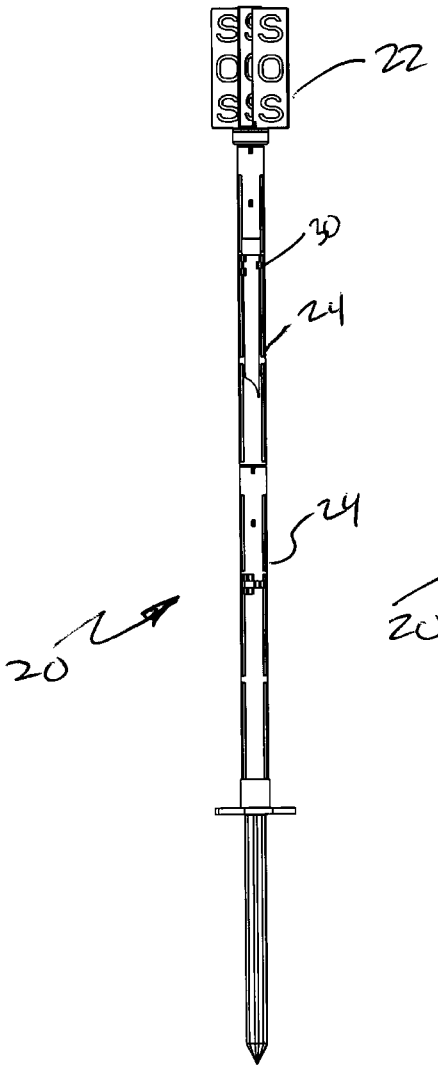
FIG. 1 is a front elevational view of a vehicle emergency distress indicator according to a first preferred embodiment of the present invention.
Figure 2:
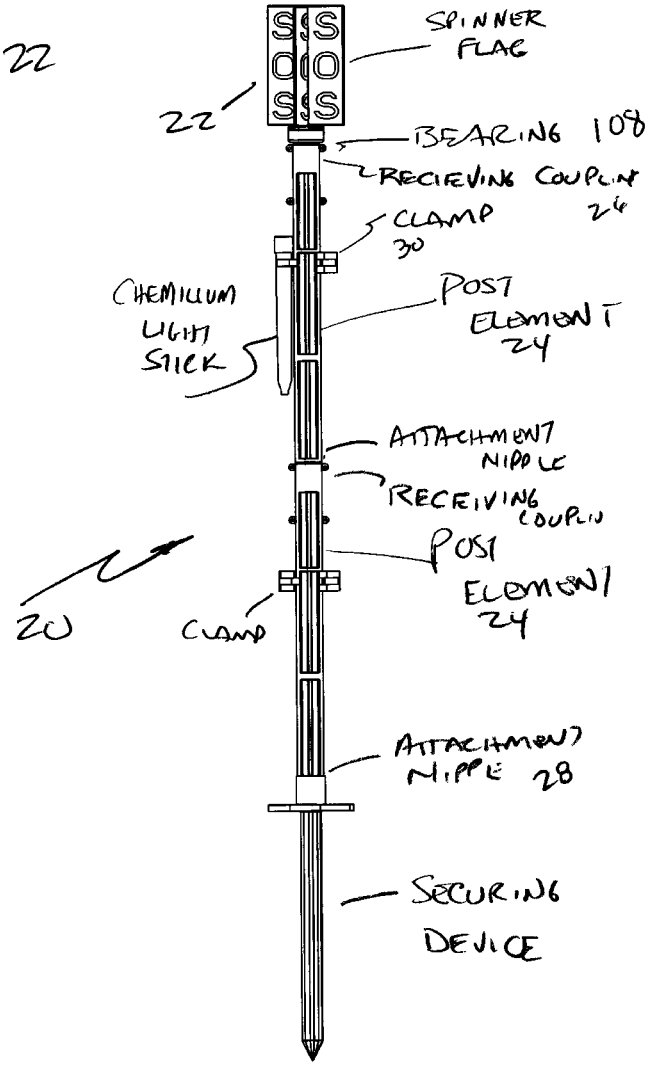
FIG. 2 is a side elevational view thereof.
Figure 3:
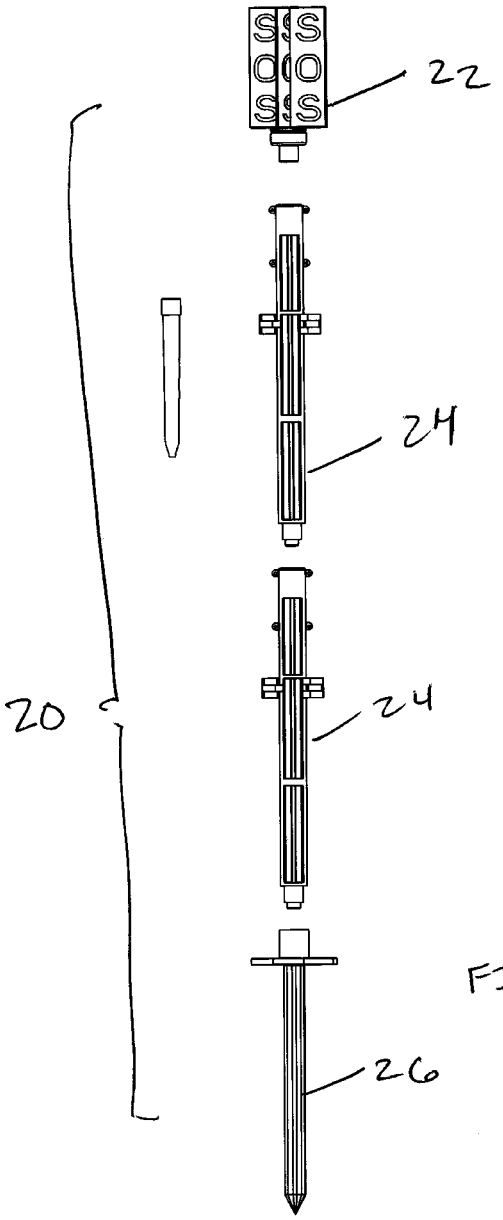
FIG. 3 is an exploded side elevational view thereof.

Referring now to the drawings, wherein like reference numerals indicate the same parts throughout the several views, an emergency distress indicator, generally noted as 20, is provided as shown generally in FIG. 1 through FIG. 3, including: an indicia flag 22; at least one vertical post element 24; and a securing device, generally noted as 26. The securing device 26 may be provided in a number of different configurations, as will be described in greater detail below.

The systems can further comprise a modular kit, as will also be further described in greater detail below.

Figure 10:
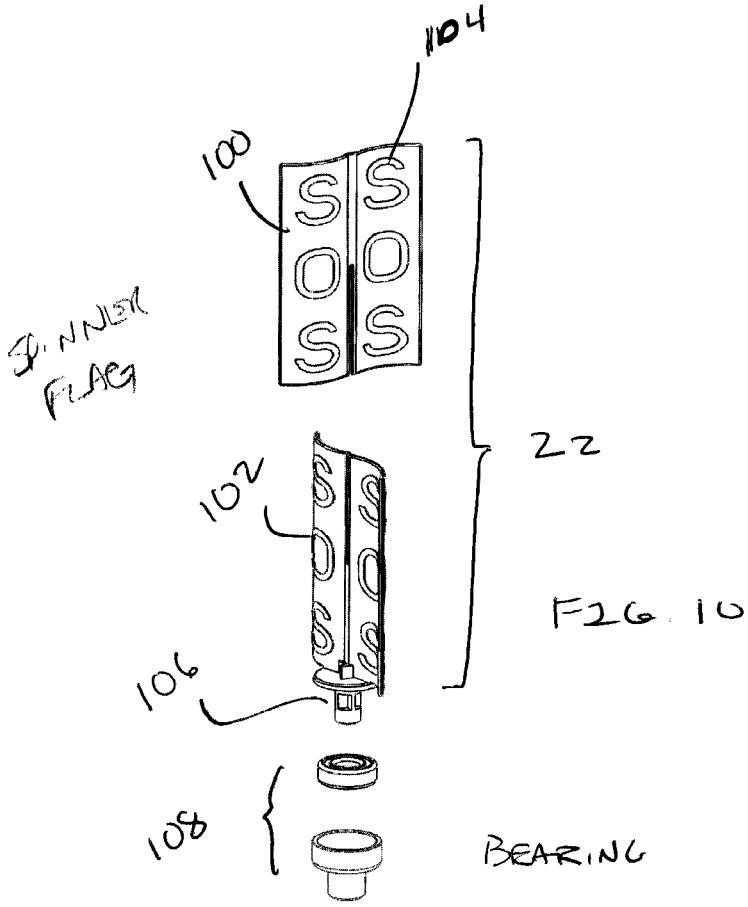
FIG. 10 is an exploded perspective view of a spinner flag 22 for use therewith.
Figure 11A:
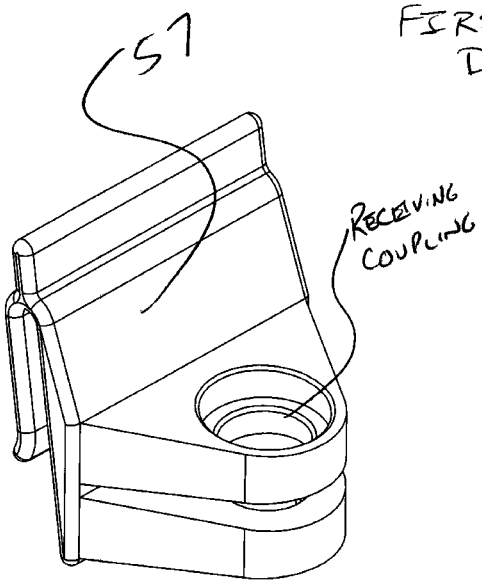
FIG. 11A through FIG. 11D are perspective, top plan, side elevational and front elevational views, respectively, of a securing device 55 for use in conjunction with the present invention according to the first preferred embodiment.
Figure 11B:
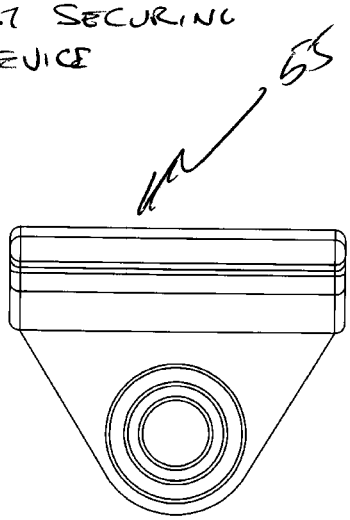
Figure 11C:
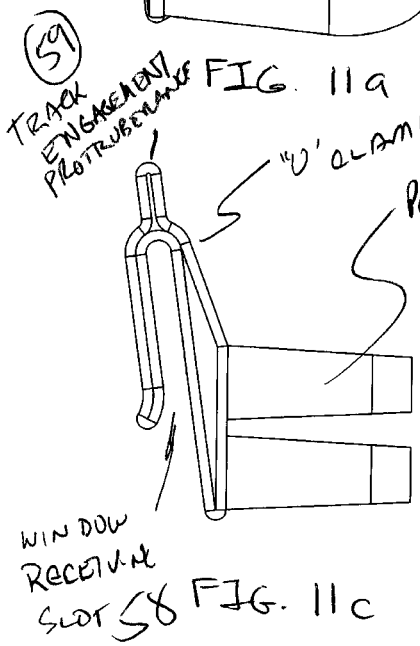
Figure 11D:
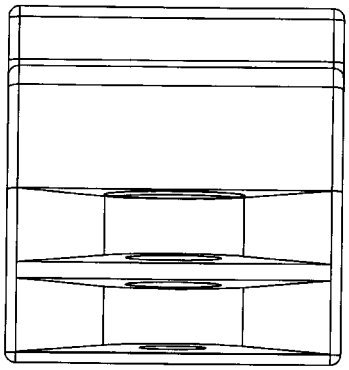
Figure 12A:
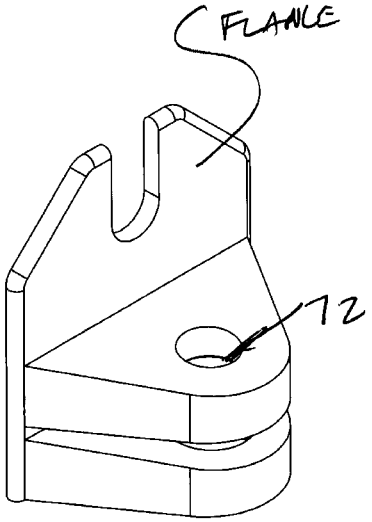
FIG. 12A through FIG. 12D are perspective, top plan, side elevational and front elevational views, respectively, of a securing device 70 for use in conjunction with the present invention according to the second preferred embodiment.
Figure 12B:
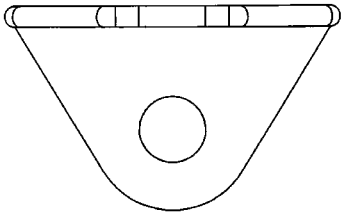
Figure 12C:
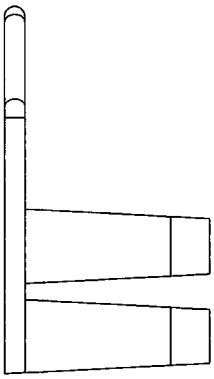
Figure 12D:
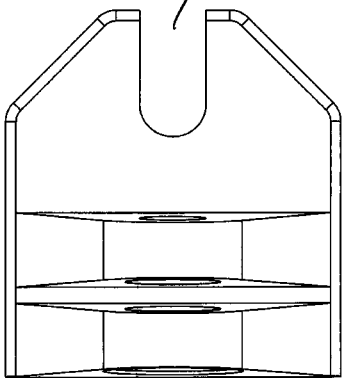
Figure 13A:
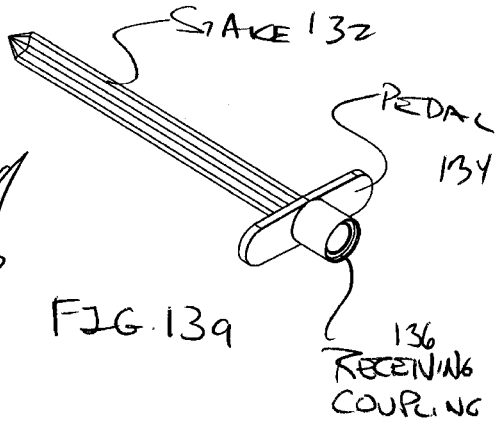
FIG. 13A through FIG. 13D are perspective, side elevational, front elevational and top plan views, respectively, of a securing device 130 for use in conjunction with the present invention according to the fourth preferred embodiment.
Figure 13C:
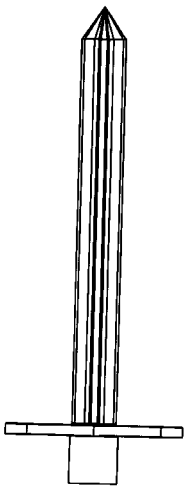
Figure 13B:
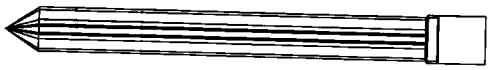
Figure 13D:
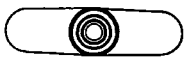
Figure 14A:
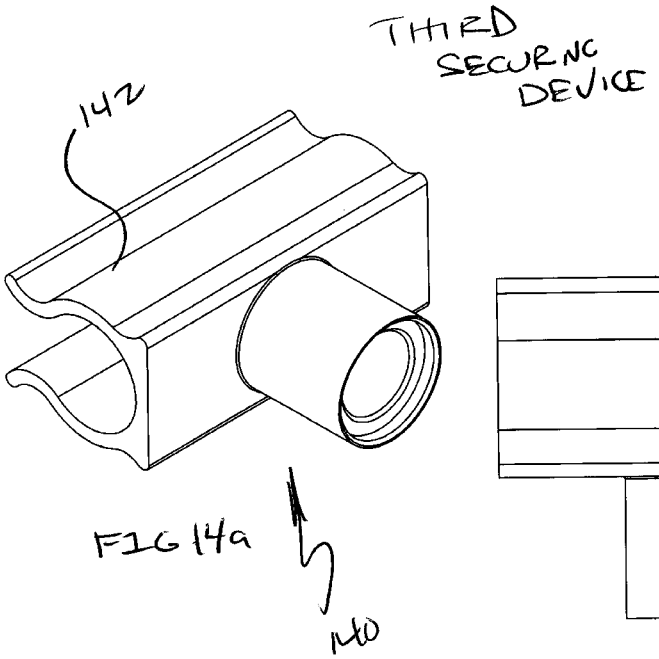
FIG. 14A through FIG. 14D are perspective, front elevational, side elevational and top plan views, respectively, of a securing device 26 for use in conjunction with the present invention according to the third preferred embodiment 140.
Figure 14B:
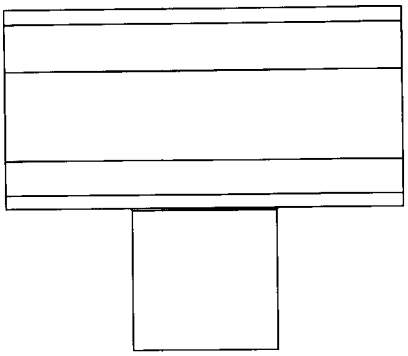
Figure 14C:
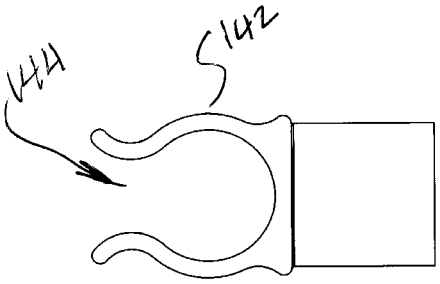
Figure 14D:
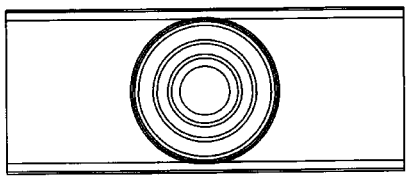

The indicia flag 22, as shown in conjunction with FIG. 10, may be a rotating/spinning indicator in a first preferred embodiment. The indicator 22 is formed of a pair of perpendicularly affixed, reflective plastic or metallic placards 100, 102 that that provides equal visibility about 360° around the emergency distress indicator 20. As shown in greater detail in FIG. 10, an first placard 100 is slottingly engaged with a second placard 102. Each placard 100, 102 displays an indicia 104, shown herein as displaying the universal distress signal moniker "S-O-S". Such an indicia S-O-S is merely exemplary. It should be apparent to a person having ordinary skill in the relevant art, in light of the present invention, that various other indicia may be used to draw attention and elicit emergency responders and, as such, should be considered within the range of intended equivalents of the present invention. Such alternatives may include, for example, "H-E-L-P" or "E-M-E-R-G-E-N-C-Y" or other similar indicia or variations of the same in a different, location specific language. Second placard 102 further includes an connection axle 106 that fittingly engages with a rotating bearing 108. Such features provide for the indicator 22 of the first preferred embodiment to rotate freely such as to be able to be wind driven, thereby spinning and providing a highly visible reflective indicator.

Figure 16:
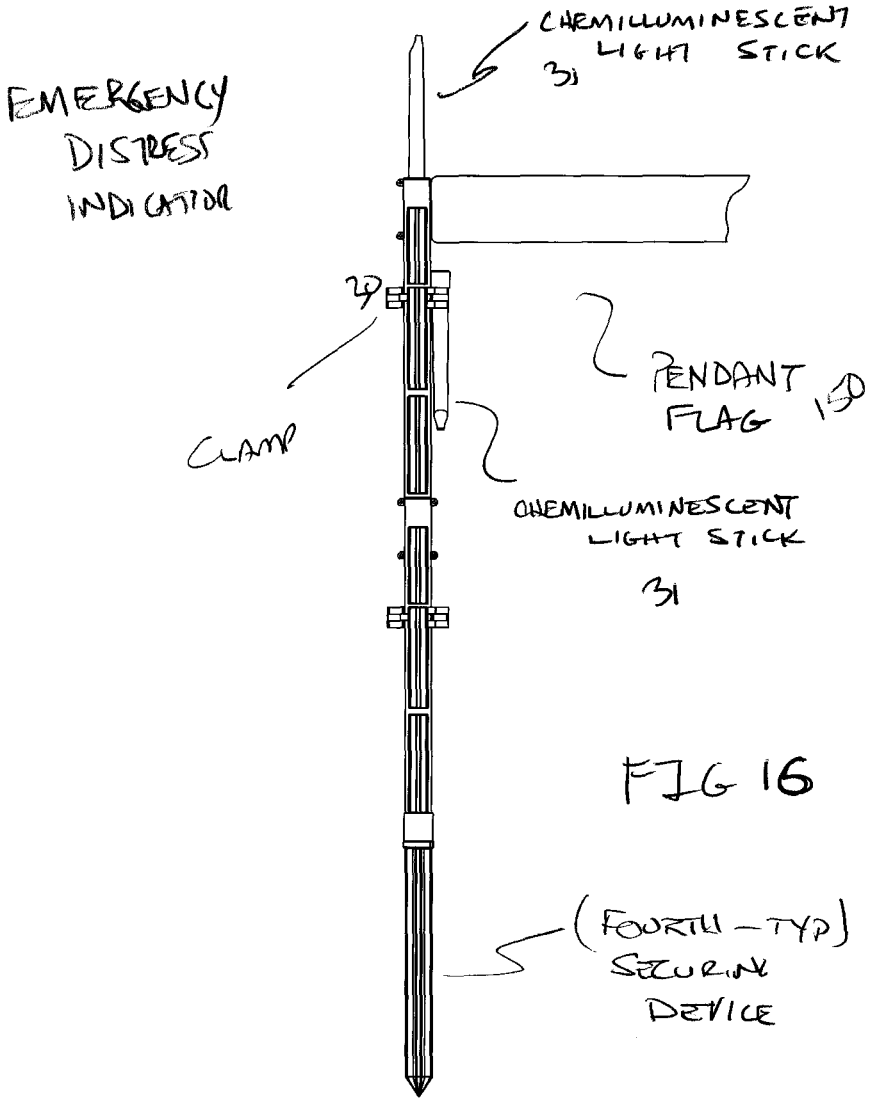
FIG. 16 is a side elevational view of a vehicle emergency distress indicator according to a second preferred embodiment of the present invention.

Additionally, an alternate pendant type of indicia flag 150, as shown in FIG. 16, may be used as a cantilevered supported pendant placard.

Figure 15:
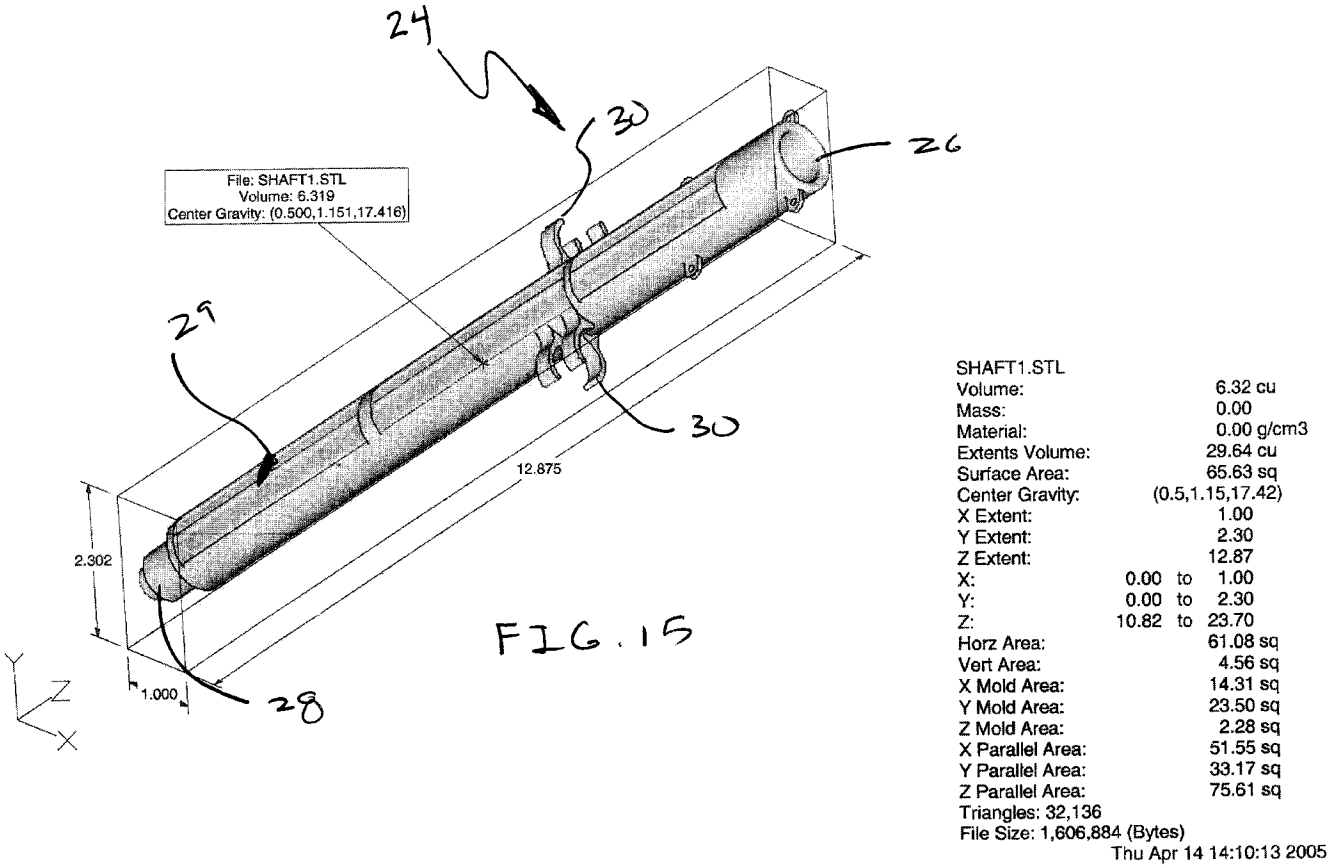
FIG. 15 is perspective view of a post element 24 for use in conjunction with any of the preferred embodiments of the present invention.

The vertical post element 24 is provided to support the indicator 22 at its upper end. As shown in greater detail in conjunction with FIG. 15, the vertical post element 24 is formed as a linearly elongated member in which a receiving coupling 26 is formed at an upper end and an attachment nipple 28 is formed at the lower end. Formed of a metallic or plastic reflective material, the post element 24 is modular such that a plurality of post elements 24 may be affixed end to end such as to vertically linearly extend the indicator 22 to a higher position for increased visibility. Visibility being primary to identification of an emergency indicator, the use of a micro prismatic retro-reflective material for forming the post elements 24 or placards 100, 102 would provide for increased reflectivity, even under low beam head lights from an automobile, to provide shine back to the light source instantly, making it self-sufficient and requiring no batteries, electricity nor maintenance. The vertical post shaft includes and forms a concave recess 29 that is formed along the vertical linear length of the shaft. Within the recess 29 is a reflective surface. The reflective surface, in conjunction with the concavity of the surface's position, provides for a reflectivity of incoming light about a large incident arc. Further, each vertical post element 24 can further incorporate additional features including, but not limited to, one or more receiving and holding mechanisms 30 adaptable for affixing a variety of accessories. One such holding mechanism 30 is shown as adapted as a retaining clamp for securing a chemiluminescent light stick or glow stick glow stick 31 of the type conventionally available for providing self-contained, short-term light-source and often used as a light source during military, police, fire, or EMS operations. The inclusion of a number of glow sticks 31 may be incorporated as part of modular kit utilizing the present invention.

Figures 4, 5:
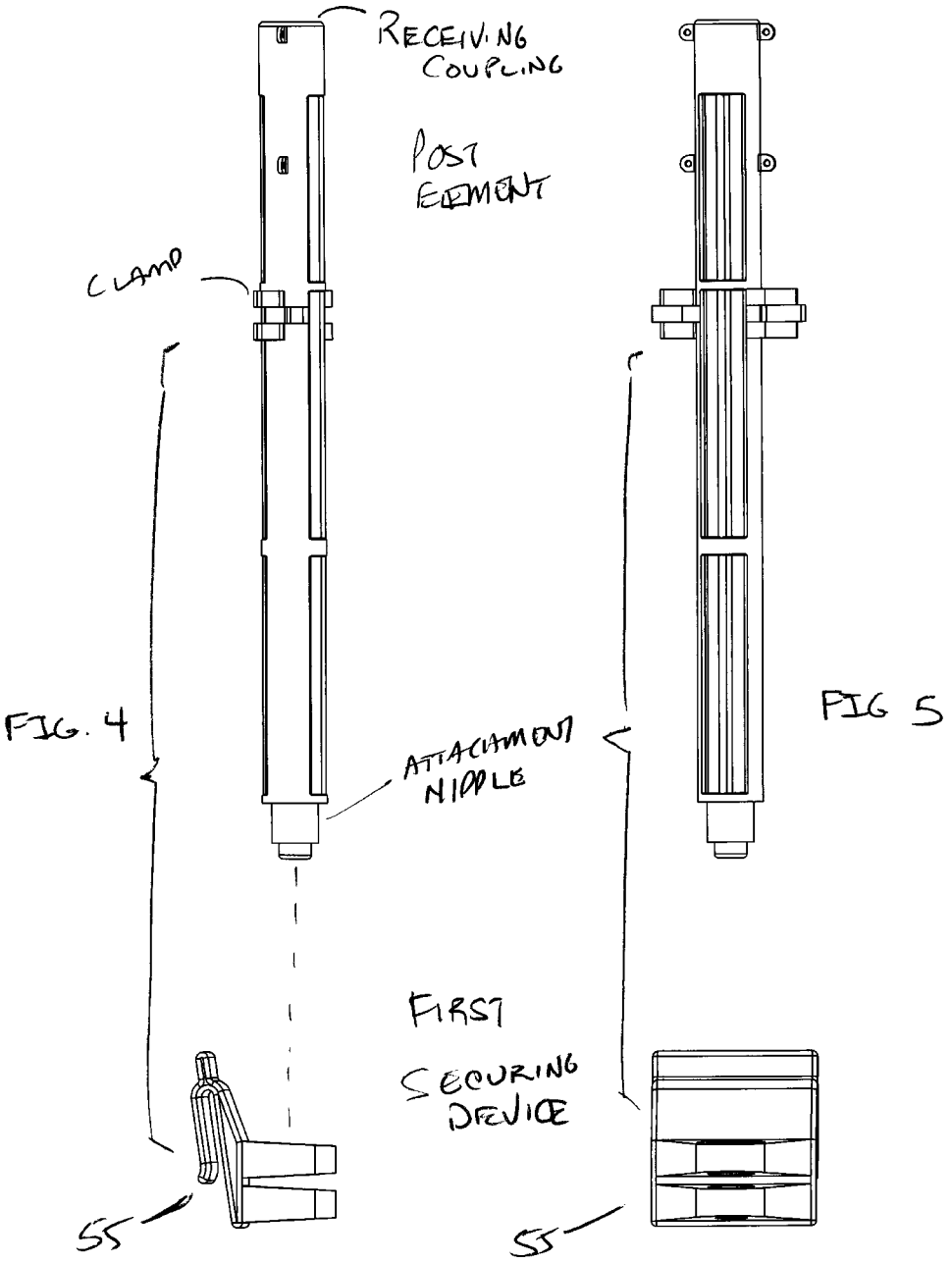
FIG. 4 is an exploded front elevational view of a post element 24 shown coordinated with a securing device 26 according to a first preferred embodiment 55.
FIG. 5 is an exploded side elevational view thereof.

Finally, the securing device, generally noted as 26, is anticipated as being of any number of specially adapted elements for securing the post element 24 rigidly in a fixed place about various surfaces. As shown in conjunction with FIG. 4 and FIG. 5, a first securing device 55 is shown to which the attachment nipple 28 at the lower end of a post element 24 is secured. The first securing device 55, shown in greater detail in conjunction with FIG. 11A through FIG. 11D, is adapted for securing onto a side window of a vehicle. An inverted U-shaped clamp element 57 forms a window receiving slot 58 at the underside that is designed to impinge about a side, movable window of a vehicle. Opposite the slot 58 is formed in a laterally elongated manner a track engagement protuberance 59 adapted to wedge into a window track formed by a vehicle door (not shown). With such a configuration, a user may roll down a vehicle window, slide the receiving slot 58 onto the pane, and then roll the vehicle window up in order to securely squeeze the securing device 55 onto the window. A receiving coupling 60 forms a post receiving cavity cantilevered from the clamp element 57 in order to engage with and secure a post element 24 as indicated above.

Figure 6:
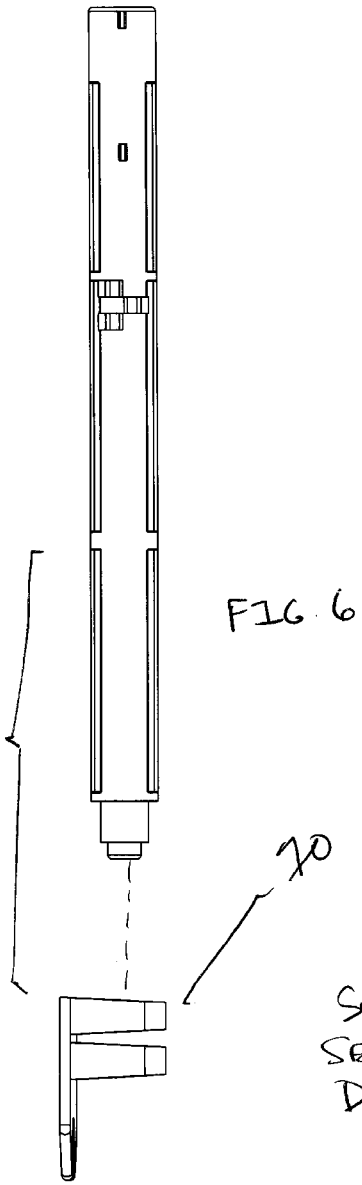
FIG. 6 is an exploded front elevational view of a post element 24 shown coordinated with a securing device 26 according to a second preferred embodiment 70.
Figure 7:
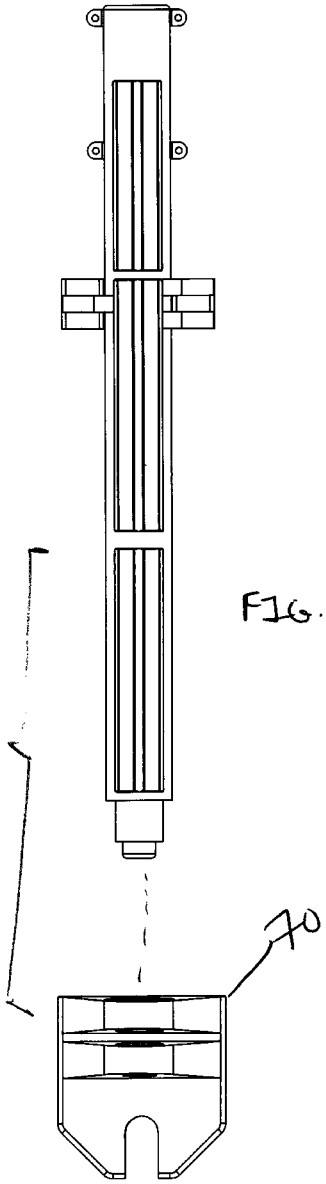
FIG. 7 is an exploded side elevational view thereof.

A second preferred embodiment of the post element 24 is shown in conjunction with FIG. 6 and FIG. 7. The second securing device 70 provides an alternate receiving coupling 72 to which the attachment nipple 28 at the lower end of a post element 24 is secured. The second securing device 70, shown in greater detail in conjunction with FIG. 12A through FIG. 12D, is adapted for securing onto the side of a general vertical surface. A connector receiving slot 74 is formed about a side flange 78. The receiving coupling 72 forms a post receiving cavity cantilevered from the flange 78 in order to engage with and secure a post element 24 as indicated above.

Figures 8, 9:
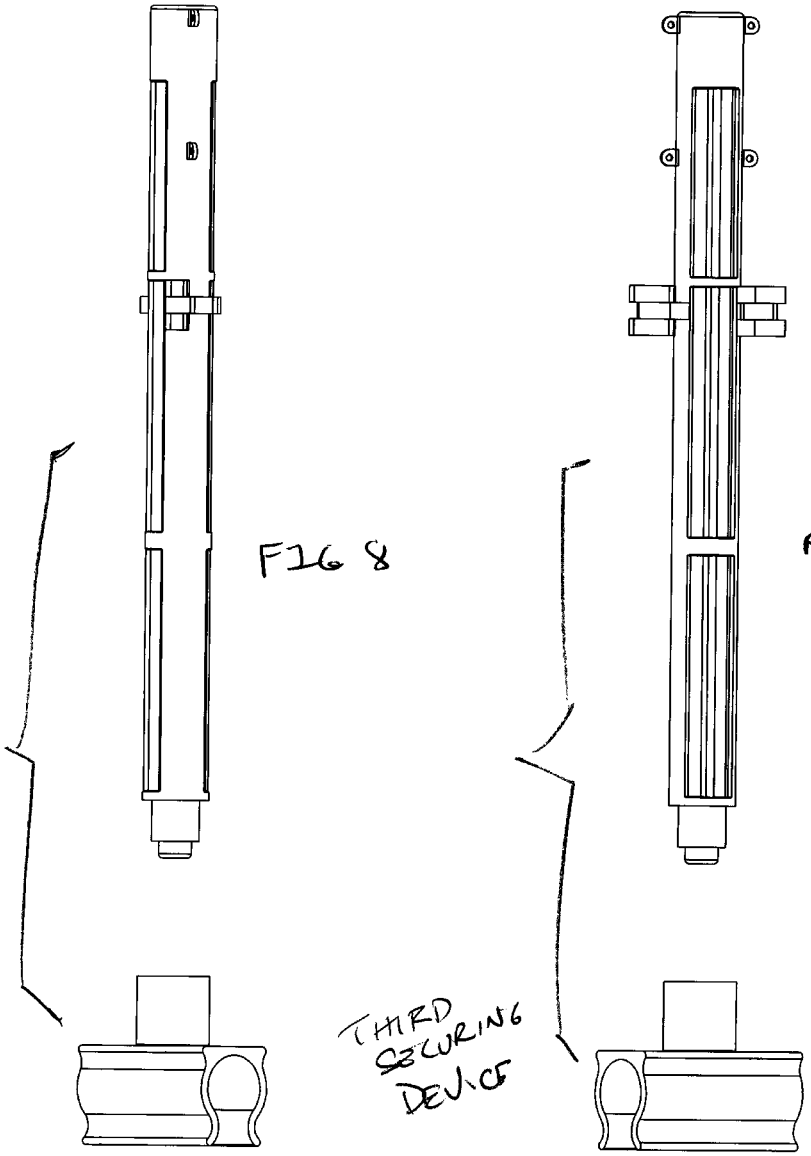
FIG. 8 is an exploded front elevational view of a post element 24 shown coordinated with a securing device 26 according to a third preferred embodiment 140.
FIG. 9 is an exploded side elevational view thereof.

A third preferred embodiment of the securing device 26, generally noted as 140, is shown in conjunction with FIG. 8 and FIG. 9. The third securing device 140 is shown to which the attachment nipple 28 at the lower end of a post element 24 is secured. The third securing device 140, shown in greater detail in conjunction with FIG. 14A through FIG. 14D, is adapted for securing onto a pipe, railing or other similar horizontally disposed structure. An inverted C-shaped clamp element 142 forms a receiving slot 144 at the underside that is designed to impinge about a connection object. Opposite the slot 144 a receiving coupling 146 forms a post receiving cavity disposed vertically from the clamp element 142 in order to engage with and secure to a post element 24 as indicated above.

Finally, the securing device 26, in a fourth preferred embodiment, is shown in conjunction with FIG. 1 through FIG. 3. The fourth securing device 130 is shown to which the attachment nipple 28 at the lower end of a post element 24 is secured. The fourth securing device 130, shown in greater detail in conjunction with FIG. 13A through FIG. 13D, is adapted as a ground securing spike in which a stake portion 132 is designed for insertion into the ground. A pedal flange 134 terminates the upper end of the stake portion 132 and a receiving coupling 136 is formed linearly opposite the stake 132. The receiving coupling 136 forms a post receiving cavity 138 in order to engage with and secure a post element 24 as indicated above.

Figure 17:
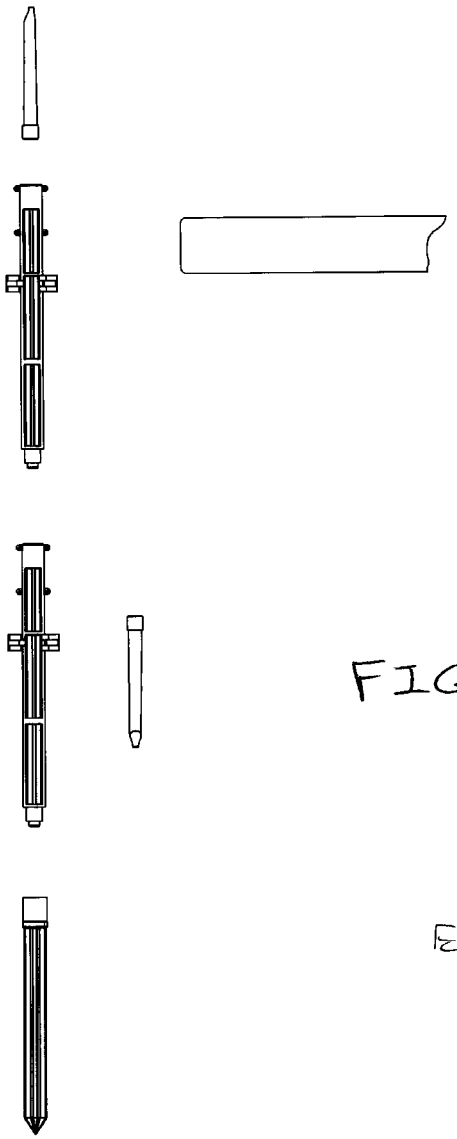
FIG. 17 is an exploded side elevational view thereof.

As can be seen in conjunction with FIG. 16 and FIG. 17, many of the functional elements of the primary embodiment may be reorganized to form an alternate configuration. Various adaptations, such as the use of a pendant style flag indicator 150 and various connectors, allow for alternate placement of chemiluminescent glow stick lighting elements 31.

2. Operation of the Preferred Embodiment

In operation, the present invention provides a distress indicia marker for signaling emergency situations. Stored in a kit form in which one or more indicator flags, one or more vertical post elements, and one or more securing device are provided, the modular inter-attachment between elements allows a user to select a securing device most appropriate for the surface being connected, from which a vertically elongated distress indicia marker is assembled. The use of multiple vertical post elements allows for a higher position for the indicator flag. Addition of other items, such as chemiluminescent glow sticks attachable to the post element provides for additional visibility in low light conditions.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722 (2002), or other similar case-law or subsequent precedent should not be made if any future claims that are added or amended subsequent to this Patent Application.

What is claimed is:

1. A distress indicia marker for signaling emergency situations comprising:

an indicia flag;

at least one vertical post element provided to support the indicia flag at an upper end, each said vertical post element further formed as a linearly elongated member forming a linearly disposed reflective concave channel and in which a receiving coupling is formed at the upper end and an attachment nipple is formed at a lower end;

a retro plasmatic light reflective compound coating said concave channel; and a securing device, wherein said attachment nipple of at least one vertical post element is retained by said securing device to a surface.

2. The distress indicia marker of claim 1, wherein said indicia flag comprises a rotating/spinning indicator formed of a pair of perpendicularly affixed, reflective plastic or metallic placards that provides equal visibility 360° about a perimeter around the emergency distress indicator.

3. The distress indicia marker of claim 2, wherein said pair of perpendicularly affixed, reflective plastic or metallic placards comprises:

a first placard slottingly engaged with a second placard;

said first placard displaying an indicia;

said second placard displaying the indicia; and wherein said indicia is selected from the group comprising: "S-O-S"; "H-E-L-P"; and "E-M-E-R-G-E-N-C-Y".

4. The distress indicia marker of claim 3, wherein said second placard further comprises a connection axle that fittingly engages with a rotating bearing, wherein said second placard rotates freely such as to be able to be wind driven, thereby spinning and providing a highly visible reflective indicator.

5. The distress indicia marker of claim 1, wherein said vertical post element is formed of a metallic or plastic reflective material.

6. The distress indicia marker of claim 5, wherein said vertical post element is formed modularly such that a plurality of post elements may be affixed end to end in a vertically linearly extended manner.

7. The distress indicia marker of claim 5, wherein said vertical post element forms a receiving and holding mechanism adaptable for affixing an accessory thereto.

8. The distress indicia of claim 7, further comprising a chemiluminescent light stick or glow stick glow stick attachable to said receiving and holding mechanism.

9. The distress indicia of claim 1, wherein said securing devices comprises:

an inverted U-shaped clamp element forming a window receiving slot at an underside that is adapted to impinge about a side, movable window of a vehicle;

a laterally elongated track engagement protuberance formed opposite said window receiving slot, said protuberance formed adapted to wedge into a window track formed by a vehicle door; and a receiving coupling forming a post receiving cavity cantilevered from said clamp element in order to engage with and secure said at least one vertical post element.

10. The distress indicia of claim 1, wherein said securing device comprises:

a receiving coupling adapted for securing onto the side of a generally vertical surface, said receiving coupling for receiving said attachment nipple formed at the lower end of said post element; and a connector receiving slot formed about a side flange, said receiving coupling forming a post receiving cavity cantilevered from the side flange in order to engage with and secure said post element.

11. The distress indica of claim 1, wherein said securing device comprises:

an inverted C-shaped clamp element forming a receiving slot at an underside and adapted to impinge about a connection object;

a post receiving cavity opposite said receiving slot and forming a post receiving cavity disposed vertically in order to engage with and secure said post element.

12. The distress indica of claim 1, wherein said securing device comprises:

a ground securing spike in which a stake portion for insertion into the ground terminates at an upper end by a flange; and a receiving coupling formed linearly opposite said stake.

13. A distress indicator kit for signaling emergency situations comprising:

an indicia flag;

at least one vertical post element provided to support the indicia flag at an upper end, each said vertical post element further formed as a linearly elongated member forming a linearly disposed reflective concave channel and in which a receiving coupling is formed at the upper end and an attachment nipple is formed at a lower end;

a plurality of securing devices; and a retro plasmatic reflective material coating a surface of said vertical post element and said indicia flag;

wherein said attachment nipple of at least one vertical post element is retained by said securing device to a surface.

14. The kit of claim 13, wherein:

said indicia flag comprises a rotating/spinning indicator formed of a pair of perpendicularly affixed, reflective plastic or metallic placards that provides equal visibility 360° about a perimeter around the emergency distress indicator; and said pair of placards comprises:

said first placard slottingly engaged with said second placard;

said first placard displaying an indicia;

said second placard displaying the indica; and wherein said indicia is selected from the group comprising: "S-O-S"; "H-E-L-P"; and "E-M-E-R-G-E-N-C-Y".

15. The kit of claim 13, further comprising said plurality of vertical post elements each formed of a metallic or plastic reflective material, wherein said vertical post element is formed modularly such that a plurality of post elements may be affixed end to end in a vertically linearly extended manner.

16. The kit of claim 13, wherein one of said plurality of securing device comprises:

an inverted U-shaped clamp element forming a window receiving slot at an underside that is adapted to impinge about a side, movable windshield of a vehicle;

a laterally elongated a track engagement protuberance formed opposite said window receiving slot, said protuberance formed adapted to wedge into a window track formed by a vehicle door; and a receiving coupling forming a post receiving cavity cantilevered from said clamp element in order to engage with and secure said post element.

17. The kit of claim 16, wherein one of said plurality of securing device comprises:

a receiving coupling adapted for securing onto the side of a generally vertical surface, said receiving coupling for receiving said attachment nipple formed at said lower end of a post element;

a retro plasmatic light reflective compound coating said concave channel; and a connector receiving slot formed about a side flange, said receiving coupling forming said post receiving cavity cantilevered from the side flange in order to engage with and secure said post element.

18. The kit of claim 17, wherein one of said plurality of securing device comprises:

an inverted C-shaped clamp element forming a receiving slot at an underside and adapted to impinge about a connection object;

a post receiving cavity opposite said receiving slot and forming a post receiving cavity disposed vertically in order to engage with and secure a post element.

19. The kit of claim 18, wherein one of said securing device comprises:

a ground securing spike in which a stake portion for insertion into the ground terminates at an upper end by a flange; and a receiving coupling formed linearly opposite said stake.

* * * * *